US006191771B1

(12) United States Patent
Kondoh

(10) Patent No.: US 6,191,771 B1
(45) Date of Patent: Feb. 20, 2001

(54) LIQUID CRYSTAL DISPLAY

(75) Inventor: Shinya Kondoh, Tokorozawa (JP)

(73) Assignee: Citizen Watch Co., Ltd., Tokyo (JP)

( * ) Notice: Under 35 U.S.C. 154(b), the term of this patent shall be extended for 0 days.

(21) Appl. No.: 09/171,781

(22) PCT Filed: Feb. 16, 1998

(86) PCT No.: PCT/JP98/00624

§ 371 Date: Oct. 26, 1998

§ 102(e) Date: Oct. 26, 1998

(87) PCT Pub. No.: WO98/38545

PCT Pub. Date: Sep. 3, 1998

(30) Foreign Application Priority Data

Feb. 27, 1997 (JP) ..... 9-043328

(51) Int. Cl.[7] ..... G09G 3/36
(52) U.S. Cl. ..... 345/100; 345/98; 345/97
(58) Field of Search ..... 345/87, 88, 89, 345/98, 100, 94, 95, 96, 97

(56) References Cited

U.S. PATENT DOCUMENTS 5,490,000 2/1996 Tanaka et al. .

FOREIGN PATENT DOCUMENTS

| | | |
|---|---|---|
| 43 12 633 | 10/1993 | (DE) . |
| 0 768 557 | 4/1997 | (EP) . |
| 2-165122 | 6/1990 | (JP) . |
| 5-119746 | 5/1993 | (JP) . |
| 6-202078 | 7/1994 | (JP) . |
| 8-292429 | 11/1996 | (JP) . |
| 8-313875 | 11/1996 | (JP) . |
| 9-15561 | 1/1997 | (JP) . |

*Primary Examiner*—Xiao Wu
(74) *Attorney, Agent, or Firm*—Finnegan, Henderson, Farabow, Garrett & Dunner, L.L.P.

(57) ABSTRACT

In a liquid crystal display using a liquid crystal exhibiting a smectic phase, a display of good quality is accomplished by alleviating the burn-in phenomenon caused by its layer structure or by an internal electric field induced by spontaneous polarization. To achieve this, the liquid crystal display is equipped with a display data conversion circuit which forcibly sets an arbitrary pixel into a prescribed display state for a prescribed period regardless of the display data to be written to the pixel, thereby correcting the change of its layer structure and preventing the internal electric field due to the spontaneous polarization occurring in the same direction from lasting for too long a period.

12 Claims, 7 Drawing Sheets

LIQUID CRYSTAL DISPLAY

TECHNICAL FIELD

The present invention relates to a liquid crystal display, such as a liquid crystal display panel or a liquid crystal optical shutter array, that contains a matrix array of pixels having a liquid crystal layer consisting of a liquid crystal that exhibits a smectic phase.

BACKGROUND ART

Ferroelectric liquid crystals and antiferroelectric liquid crystals are generally known liquid crystals that exhibit smectic phases. These liquid crystals are used in image-producing displays by utilizing the properties that both types of liquid crystals possess spontaneous polarization, and that the direction of the spontaneous polarization changes under the influence of an external electric field. Liquid crystal panels using antiferroelectric liquid crystals, for example, have been researched vigorously since it was reported in Japanese Patent Unexamined Publication No. 2-173724 by Nippondenso and Showa Shell Sekiyu that such liquid crystal panels provided wide viewing angles, were capable of fast response, and had good multiplexing characteristics.

However, when a still image or the like is displayed on an antiferroelectric liquid crystal display with the same image pattern staying on the display for a long period of time, a phenomenon occurs in which when a different image pattern is displayed on the screen, the previously displayed image remains visible on the screen (this phenomenon is hereinafter called the "burn-in phenomenon"). This burn-in phenomenon is believed to be caused by the fact that antiferroelectric liquid crystals have a layer structure.

It is also known that, in ferroelectric liquid crystal displays using ferroelectric liquid crystals, a similar burn-in phenomenon occurs when the same pattern such as a still image has been displayed on the screen for a long period of time. This burn-in, unlike the case of antiferroelectric liquid crystals, is believed to be caused by the movement of impurity ions contained in the liquid crystal cell. Ferroelectric liquid crystals have a spontaneous polarization, and when an external voltage is 0 V, an internal electric field due to the spontaneous polarization is always present in a direction perpendicular to the liquid crystal cell. Impurity ions in the liquid crystal cell move toward the cell-substrate interface in such a manner as to cancel the internal electric field, and an ion electric field due to the impurity ions occurs in a direction opposite to the direction of the internal electric field. If this condition continues for a long period of time, the impurity ions are adsorbed onto the cell-substrate interface. As a result, the ion electric field persists after the internal electric field due to the spontaneous polarization is removed. This is believed to cause the burn-in phenomenon.

DISCLOSURE OF THE INVENTION

Accordingly, an object of the present invention is to resolve the above-outlined problems and provide a liquid crystal display capable of producing a high contrast display. To achieve this, in a liquid crystal display using an antiferroelectric liquid crystal, the change of the layer structure due to continuous driving is corrected to alleviate the burn-in phenomenon caused by differences in the way that the layer structure changes. Further, in a liquid crystal display using a ferroelectric liquid crystal, the burn-in phenomenon is likewise alleviated by not allowing the internal electric field due to the spontaneous polarization occurring in the same direction to remain for too long a period.

To accomplish the above object, the liquid crystal display of the present invention, which contains a plurality of pixels arranged in a matrix pattern and having, between a pair of substrates, a liquid crystal exhibiting a smectic phase, comprises means for generating display data to write to the pixels, and means for forcibly setting random pixels of the plurality of pixels in a prescribed display state for a prescribed period regardless of the display data, the random pixels being distributed throughout the matrix pattern.

To describe the invention in more detail, the liquid crystal display of the present invention is a liquid crystal display that contains a plurality of pixels arranged in a matrix pattern and having, between a pair of substrates, a liquid crystal exhibiting a smectic phase, the substrates having a plurality of scanning electrodes and signal electrodes, respectively, and comprises: a display data generating circuit for generating display data to write to the pixels; a scanning voltage generating circuit for generating, based on the display data from the display data generating circuit, a scanning voltage to be applied to the scanning electrodes; a signal voltage generating circuit for generating, also based on the display data from the display data generating circuit, a signal voltage to be applied to the signal electrodes; and a display data conversion circuit for converting the display data in order to forcibly set random pixels of the plurality of pixels in a prescribed display state for a prescribed period regardless of the display data, the random pixels being distributed throughout the matrix pattern.

The display data conversion circuit is provided between the display data generating circuit and the signal voltage generating circuit, and has a function to designate the pixel whose display data is to be converted or a function to randomly determine the pixel whose display data is to be converted.

The display data conversion circuit also has a function to set the interval at which the display data is converted to an arbitrary value or a function to automatically change the display data conversion interval.

Further, the display data conversion circuit has a function to arbitrarily set the number of pixels per scanning line whose display data is to be converted forcibly or a function to automatically change the number of pixels per scanning line whose display data is to be converted forcibly.

Furthermore, the display data conversion circuit has a function to set the level of the prescribed display state, to which the conversion is to be made, to an arbitrary level, and to automatically change this level.

ADVANTAGEOUS EFFECTS OF THE INVENTION

When a display is produced on a liquid crystal display using the present invention, differences between display pixels in the way that the layer structure changes can always be eliminated, or the occurrence of the internal electric field due to the spontaneous polarization can be held within a short period of time; this alleviates the burn-in phenomenon and provides a good display with no degradation in display quality.

DETAILED DESCRIPTION OF THE INVENTION

Figure 1:
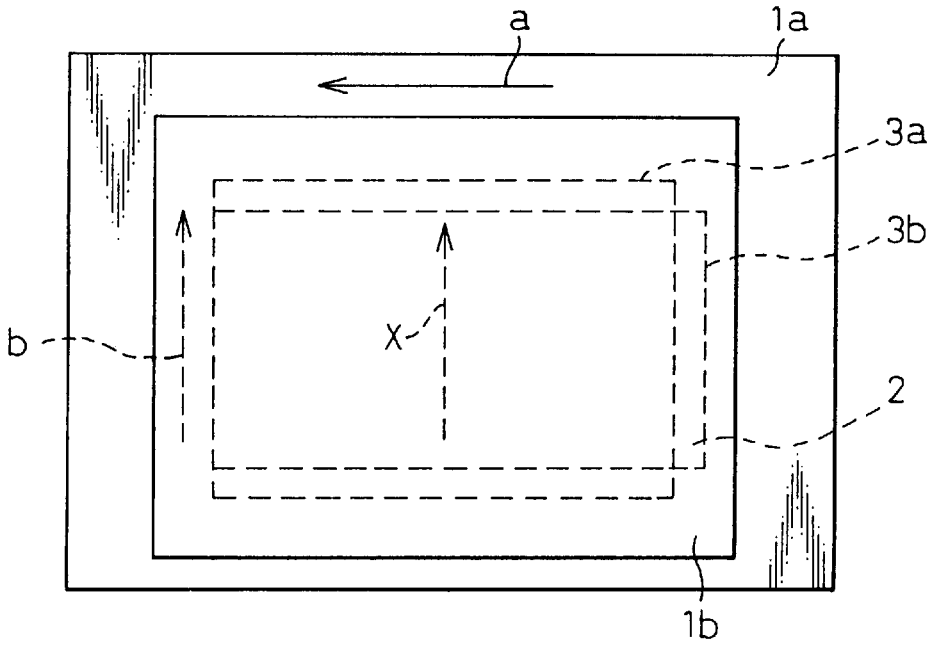
FIG. 1 is a diagram showing the arrangement of a polarizing plate in a display using an antiferroelectric liquid crystal.

FIG. 1 is a diagram showing the arrangement of polarizing plates in a display using an antiferroelectric liquid crystal. Between the polarizing plates 1*a* and 1*b*, arranged in a crossed Nicol configuration, is placed a liquid crystal cell 2 in such a manner that the average long axis direction x of molecules in the absence of an applied voltage is oriented substantially parallel to either the polarization axis, a, of the polarizing plate 1*a* or the polarization axis, b, of the polarizing plate 1*b*. Then, the liquid crystal cell is set up so that black is displayed when no voltage is applied and white is displayed when an electric field is applied. Reference numerals 3*a* and 3*b* are glass substrates between which a liquid crystal layer is sandwiched. When a voltage is applied across the thus structured liquid crystal cell, the optical transmittance varies with the applied voltage, describing a loop as plotted in the graph of FIG. 2. The voltage value at which the optical transmittance begins to change when the applied voltage is increased is denoted by V1, and the voltage value at which the optical transmittance reaches saturation is denoted by V2. On the other hand, the voltage value at which the optical transmittance begins to drop when the applied voltage is decreased is denoted by V5. Further, the voltage value at which the optical transmittance begins to change when a voltage of opposite polarity is applied and the absolute value of the applied voltage is increased, is denoted by V3, and the voltage value at which the optical transmittance reaches saturation is denoted by V4. On the other hand, the voltage value at which the optical transmittance begins to change when the absolute value of the applied voltage is decreased is denoted by V6. From FIG. 2, a first ferroelectric state is selected when the value of the applied voltage is greater than the threshold of the antiferroelectric liquid crystal molecules. When the voltage of the opposite polarity greater than the threshold of the antiferroelectric liquid crystal molecules is applied, a second ferroelectric state is selected. In these ferroelectric states, when the voltage value drops below a certain threshold, an antiferroelectric state is selected.

Figure 2:
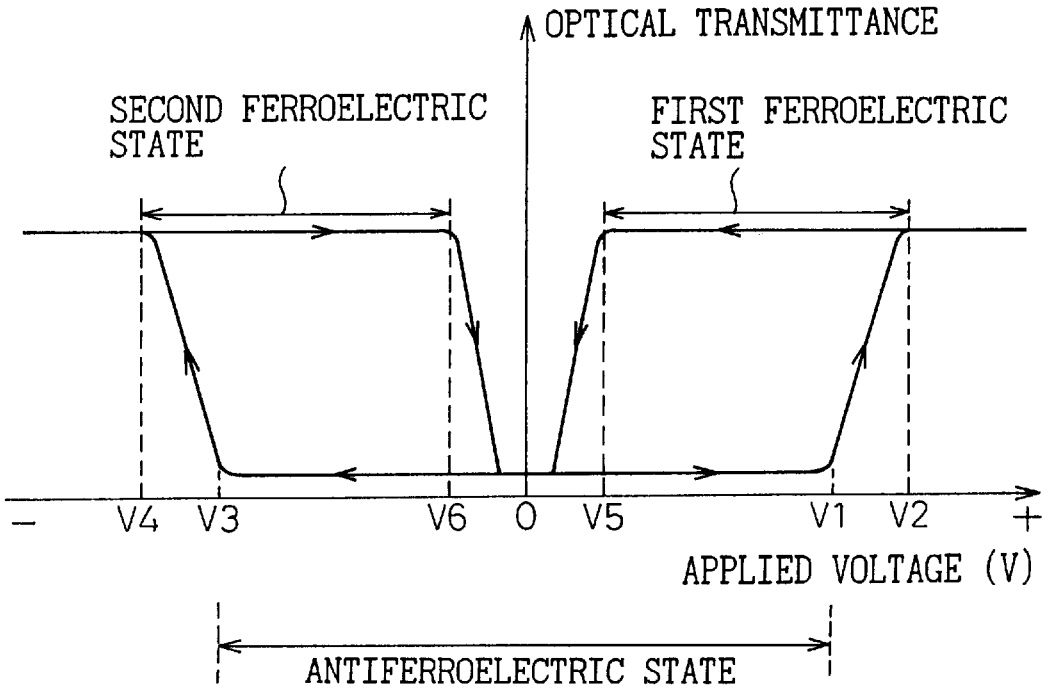
FIG. 2 is a diagram showing a hysteresis curve for an antiferroelectric liquid crystal display element.

In comparison, ferroelectric liquid crystals have a different voltage-transmittance characteristic from that of antiferroelectric liquid crystals, and exhibit a single hysteresis curve, not a double hysteresis curve such as shown in FIG. 2. Generally, in a display using an ferroelectric liquid crystal, the polarization axis of either one of the polarizing plates is aligned with the long axis direction of molecules in the ferroelectric state. Then, the liquid crystal cell is set up so that black is displayed when a voltage greater than a certain voltage is applied, and white is displayed when an opposite polarity voltage greater than a certain voltage is applied.

Figure 3:
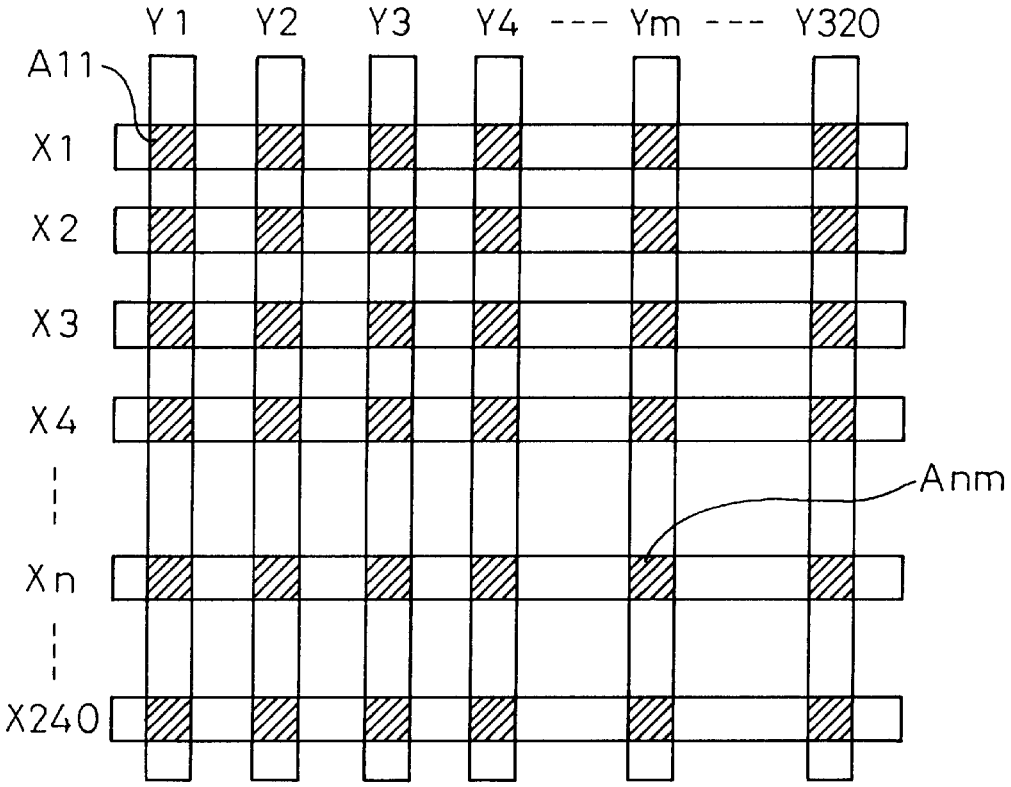
FIG. 3 is a diagram showing an electrode arrangement in a liquid crystal panel in which electrodes are arranged in a matrix form.
Figure 4:
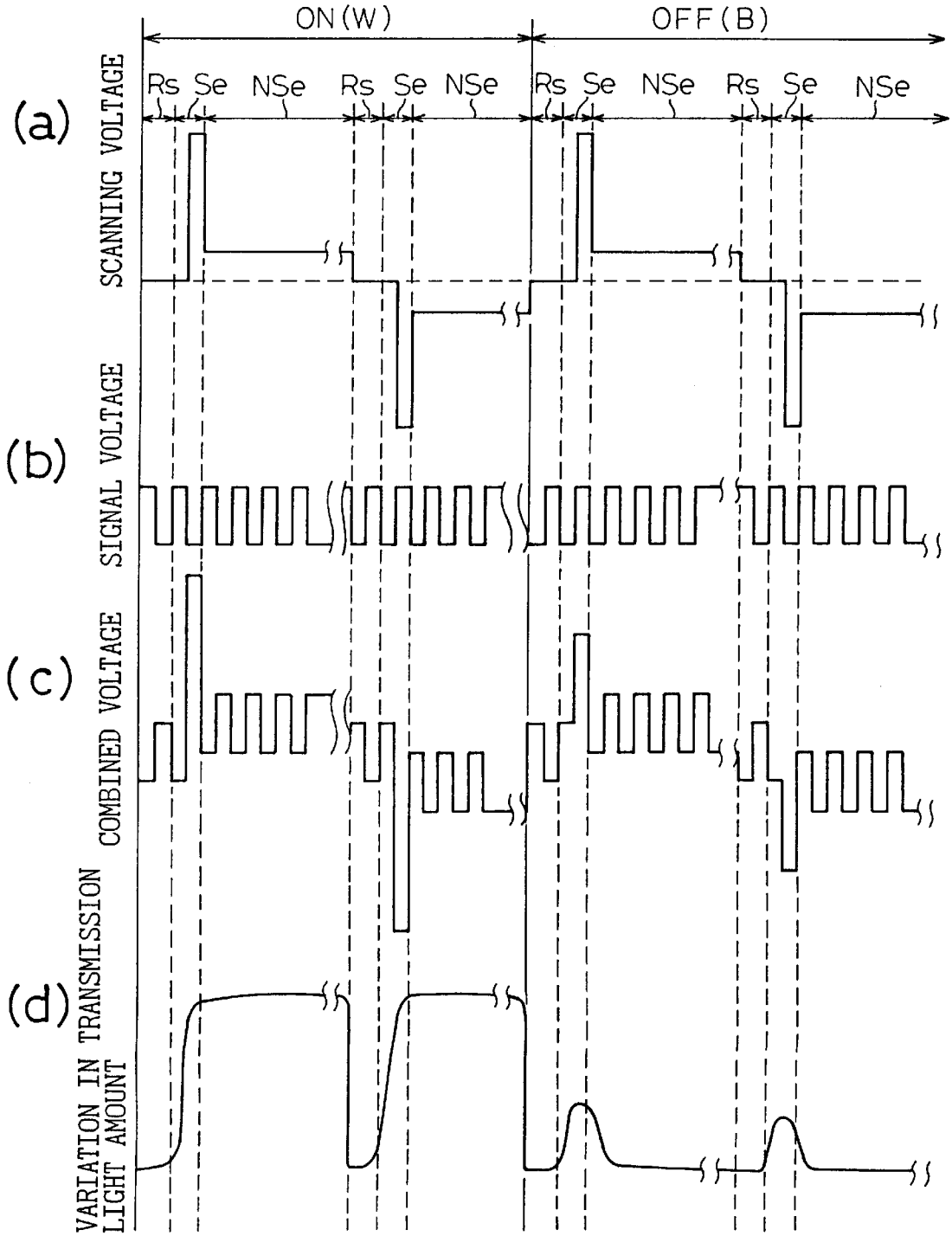
FIG. 4 is a diagram showing an antiferroelectric liquid crystal driving method according to the conventional art.

Next, a conventional liquid crystal driving method for an antiferroelectric liquid crystal will be described. FIG. 3 is a diagram showing an example of an electrode arrangement in a liquid crystal panel having scanning electrodes and signal electrodes arranged in a matrix form on substrates. This electrode arrangement consists of the scanning electrodes, X1, X2, . . . , Xn, . . . X240, and the signal electrodes, Y1, Y2, . . . , Ym, . . . , Y320, and shaded portions where the scanning electrodes and signal electrodes intersect are pixels (A11, Anm). When a scanning voltage (a) is applied to a scanning electrode and a signal voltage (b) to a signal electrode, their combined voltage (c) is applied to the corresponding pixel (Anm), as shown in FIG. 4, to accomplish writing to the pixel. In a selection period (Se), the first or second ferroelectric state or the antiferroelectric state is selected, and the selected state is held throughout the following non-selection period (NSe). That is, a select pulse is applied in the selection period (Se), and the transmission light amount (d) obtained as the result of the selection is maintained throughout the following non-selection period (NSe).

In the above liquid crystal driving, if the molecular state of the antiferroelectric liquid crystal, immediately before the select pulse applied in the selection period, is different, the transmission light amount of the pixel after the application of the select pulse will become difficult to control accurately to a prescribed value. Therefore, it has often been practiced to reset the state always to the antiferroelectric state prior to the application of the select pulse, regardless of the state of the pixel before being selected for display. Several methods of resetting have been practiced: in one method, resetting to the antiferroelectric state is accomplished by setting the voltage value in the reset period to 0 V and letting the liquid crystal to relax back to the antiferroelectric state by the viscosity, elasticity, or an other property that the antiferroelectric liquid crystal inherently has, and in another method, the liquid crystal is reset to the antiferroelectric state by applying an appropriate voltage.

However, as previously described, when the same image pattern has been displayed on an antiferroelectric liquid crystal display for a long period of time, as in the case of a still image or the like, a burn-in phenomenon is observed when a different image pattern is displayed on the same screen. This phenomenon will be described with reference to FIGS. 5 and 6. This burn-in phenomenon is believed to be caused by the layer structure that antiferroelectric liquid crystals have.

Figure 5:
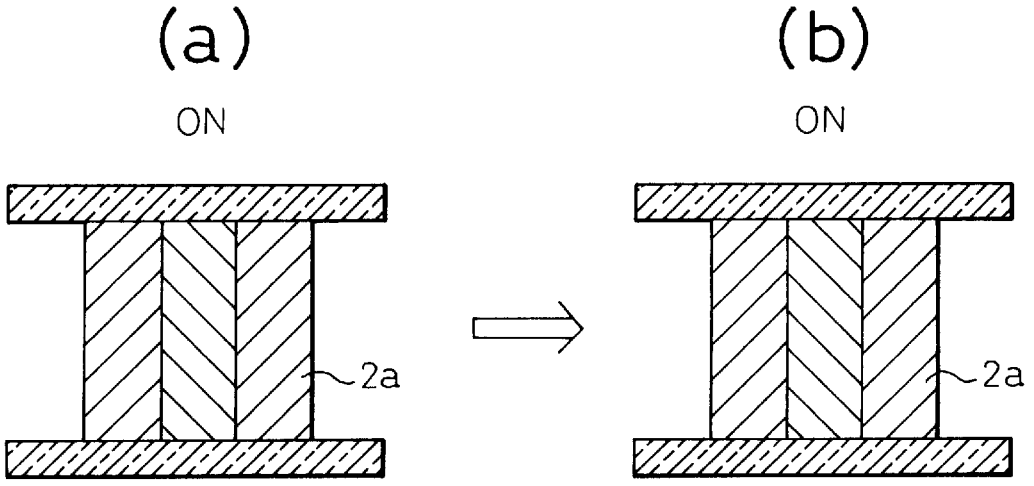
FIG. 5 is a diagram showing the way that the layer structure of antiferroelectric liquid crystal changes.
Figure 6:
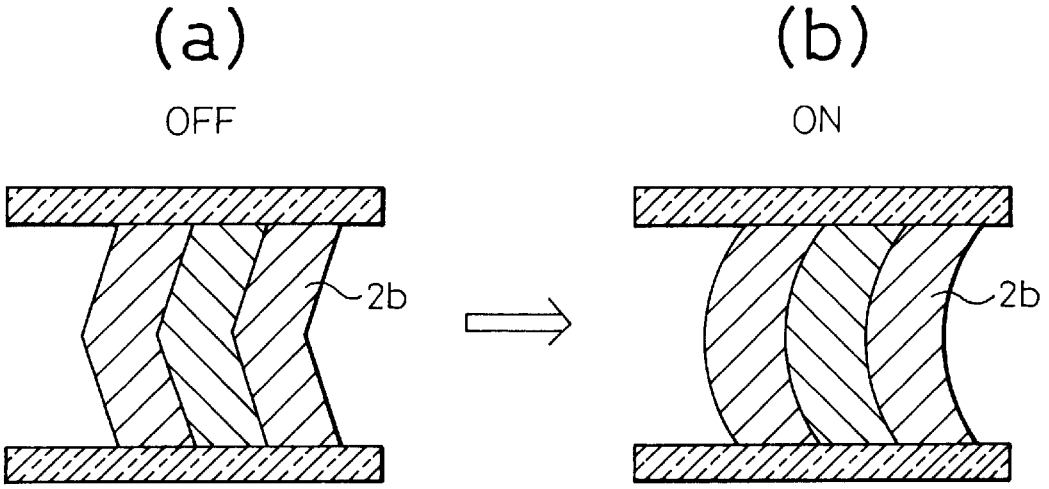
FIG. 6 is a diagram showing the way that the layer structure of antiferroelectric liquid crystal changes.

In FIG. 5, part (a) shows the layer structure (bookshelf structure) of an antiferroelectric liquid crystal in a pixel that has displayed white for a long period of time in the ferroelectric state. In FIG. 6, part (a) shows the layer structure (chevron structure) of an antiferroelectric liquid crystal in a pixel that has displayed black for a long period of time in the antiferroelectric state. When the pixel that has displayed white for a long period of time in the ferroelectric state (FIG. 5(*a*) ON . . . the bookshelf structure) is next driven in the same white state (ON), the geometry of the layer structure 2*a* does not change (see FIG. 5(*b*) ON). However, when the pixel that has displayed black for a long period of time in the antiferroelectric state (FIG. 6(*a*) OFF . . . the chevron structure) is next driven in the white state (ON), the geometry of the layer structure 2*b* changes (see FIG. 6(*b*) ON). In this way, even in the same white display state, the layer structure is different as shown by 2*a* in FIG. 5(*b*) and 2*b* in FIG. 6(*b*). Furthermore, the layer structure takes time to change from the geometry shown in FIG. 6(*b*) to the geometry shown in FIG. 5(*b*). The difference in the change of the layer structure as described above is believed to be the cause of the "burn-in phenomenon".

As described above, in the antiferroelectric liquid crystal, the layer structure in the absence of an applied voltage is the chevron structure in which the layers are bent as shown in FIG. 6(*a*) OFF. When a certain voltage is applied, the liquid crystal cell first changes to the structure shown in FIG. 6(*b*) ON and then to the bookshelf structure standing substantially perpendicular to the substrates as shown in FIG. 5(*a*) ON.

In view of this, the present invention alleviates the burn-in phenomenon by preventing differences from being caused in the way the layer structure changes because of the difference in the layer structure occurring due to continuous driving. To achieve this, an arbitrary pixel is forcibly set in a prescribed display state, that is, the liquid crystal in that pixel is forced to change to the bookshelf structure or a structure close to it.

EMBODIMENTS

Figure 7:
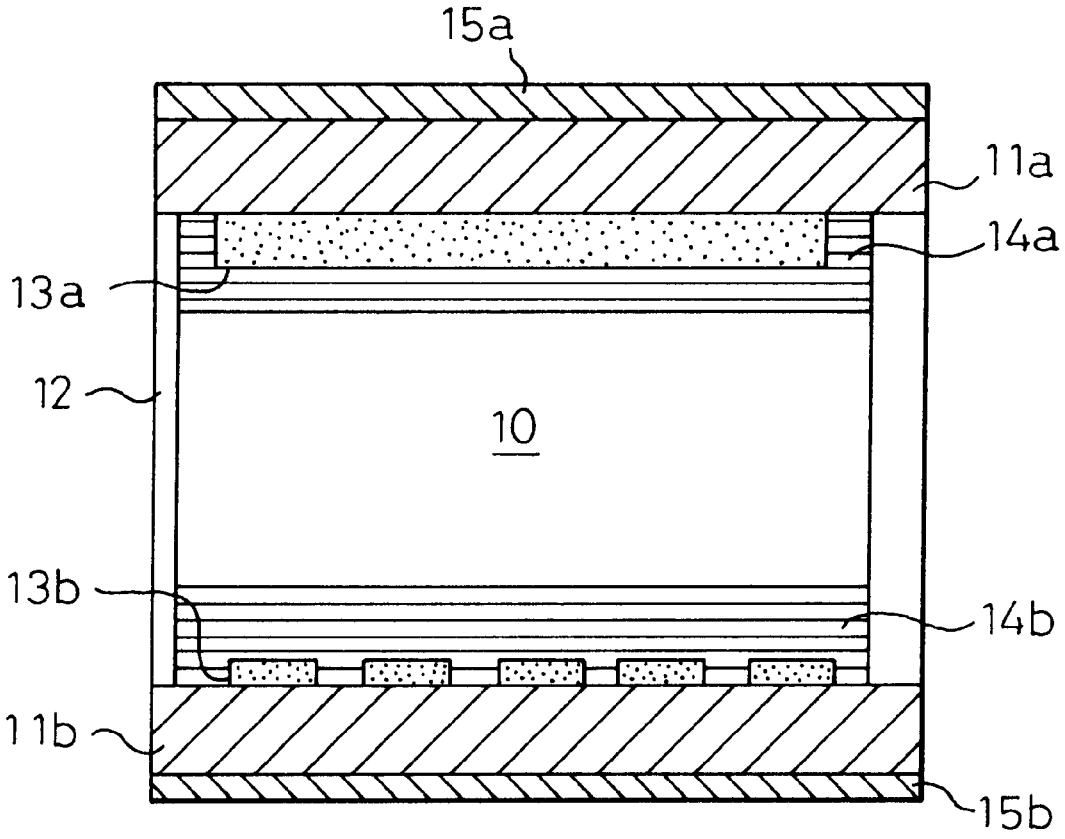
FIG. 7 is a structural diagram of a liquid crystal panel used in an embodiment of the present invention.

Embodiments of the present invention will be described in detail below with reference to the drawings. FIG. 7 is a diagram showing the structure of a liquid crystal panel used in an embodiment of the present invention. The liquid crystal panel used in this embodiment comprises a pair of glass substrates 11*a* and 11*b* between which an antiferroelectric liquid crystal layer 10 with a thickness of about 2$\mu$ is sandwiched, and a sealing material 12 for bonding the two glass substrates together. On the opposing surfaces of the glass substrates 11*a* and 11*b* are formed electrodes 13*a* and 13*b*, which are coated with polymeric alignment films 14*a* and 14*b*, respectively, that are processed by rubbing. On the outside surface of one glass substrate is arranged a first polarizing plate 15*a* with its polarization axis oriented parallel to the rubbing axis; on the outside surface of the other glass substrate, a second polarizing plate 15*b* is arranged with its polarization axis oriented at 90° to the polarization axis of the first polarizing plate 15*a*.

The scanning electrodes and signal electrodes are arranged as previously shown in FIG. 3. There are 240 scanning electrodes and 320 signal electrodes. The shaded portions where the respective electrodes intersect are pixels (A11, Anm).

Figure 8:
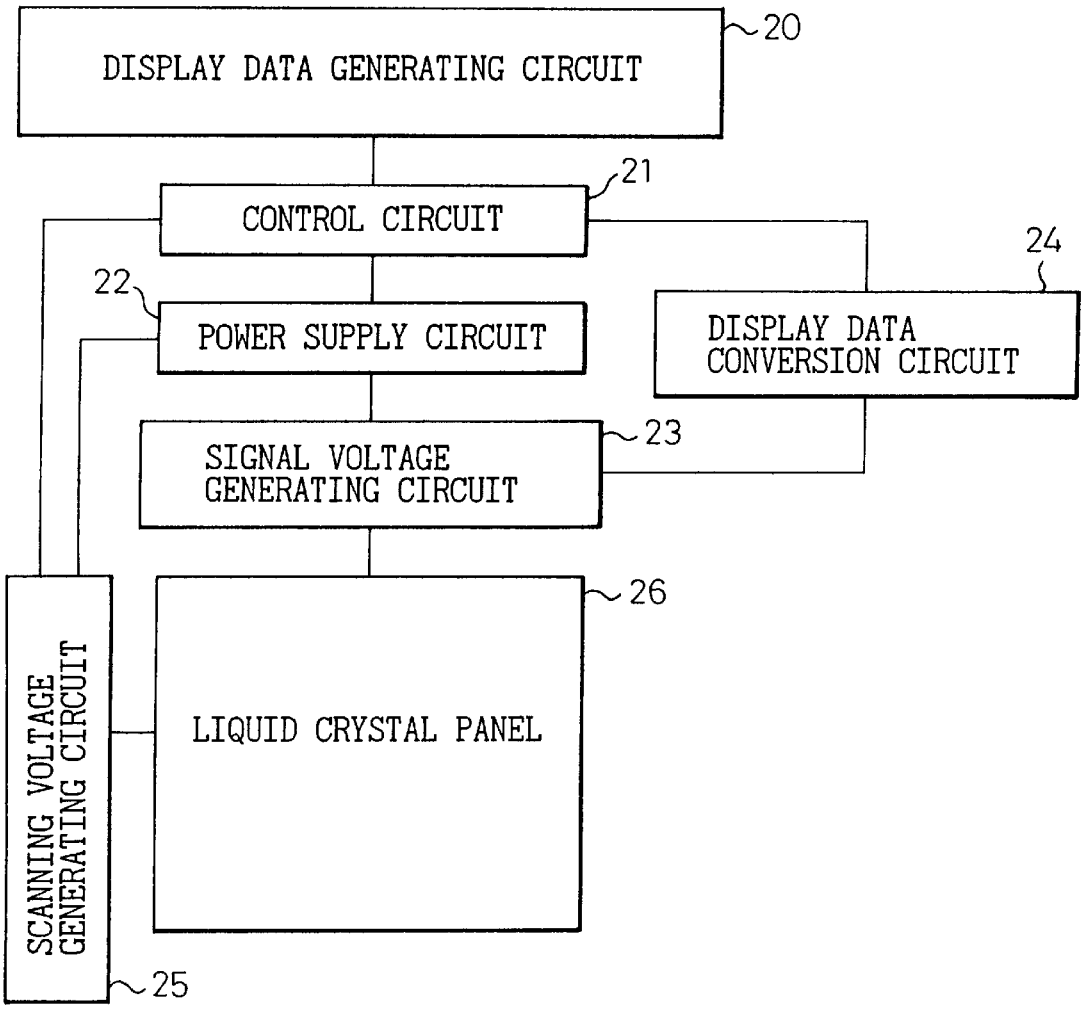
FIG. 8 is a block diagram showing an embodiment of a drive circuit for the liquid crystal display of the present invention.

FIG. 8 is a block diagram showing an embodiment of a drive circuit for the liquid crystal display of the present invention. Signals from a display data generating circuit 20 are input to a control circuit 21. Based on the display data signals from the display data generating circuit 20, the control circuit 21 controls a signal voltage generating circuit 23 and a scanning voltage generating circuit 25. Under the control of the control circuit 21, the signal voltage generating circuit 23 and the scanning voltage generating circuit 25 generate a signal voltage and a scanning voltage to drive the liquid crystal in the liquid crystal panel 26. A power supply circuit 22 is connected to the control circuit 21, the signal voltage generating circuit 23, and the scanning voltage generating circuit 25.

In the present invention, a display data conversion circuit 24 is provided between the display data generating circuit 20 and the signal voltage generating circuit 23. The display data conversion circuit 24 has the function of converting the display data from the display data generating circuit 20 in order to forcibly set random pixels in the prescribed display state. The combined voltage of the scanning voltage and the signal voltage converted by the display data conversion circuit 24 is applied to the pixel in the liquid crystal panel 26 to write to the pixel.

The display data generating circuit outputs display data signals corresponding to the number of pixels (the number of signal electrodes) on one scanning electrode. When the display data signals are input to the display data conversion circuit 24, only the display data signal corresponding to a particular pixel is converted into a display data signal for driving that pixel in the prescribed display state. With this signal, the particular pixel is forcibly set into the prescribed display state.

The display data conversion circuit 24 has the function of being able to designate the particular pixel as desired or in a random manner. For example, the position of the pixel whose display data is to be converted can be set for every scanning electrode row, for every two rows, or for every n rows. The display data conversion circuit 24 may also be provided with the function of automatically changing these settings. Furthermore, the display data conversion circuit 24 has the function of being able to arbitrarily set or change the interval at which the display data conversion is performed (for example, once for every frame or every two frames).

In the embodiment of FIG. 8, assuming that the frame period of the liquid crystal panel is about 17 ms, the display data conversion circuit 24 outputs the converted display data for forcing the display data into the white display state (the bookshelf layer structure) in the same period as the selection period (about 35 $\mu$s). If the number of pixels subjected to forcible conversion is 10 per scanning line, and the setting is made so that such pixels are selected at random, then every pixel will be set into the white display state (the bookshelf layer structure) once every 544 ms on the average.

When producing a display on an antiferroelectric liquid crystal display using the present invention, random pixels, including ones that are always driven only in the black display state (the layer structure is the chevron structure) and ones that are always driven only in the white display state (the layer structure is the bookshelf structure), are forcibly set in the prescribed display state for a prescribed period. That is, the layer structure of the liquid crystal is forced to change to the bookshelf structure or a structure close to it at prescribed intervals of time. This reduces the tendency of the layer structure of the liquid crystal to change differently, and alleviates the burn-in phenomenon.

On the other hand, when producing a display on a ferroelectric liquid crystal display using the present invention, random pixels can be forcefully set in the prescribed display state for a prescribed period, as described above. This serves to prevent the internal electric field due to the spontaneous polarization occurring in the same direction lasting for too long a period, and as a result, the burn-in phenomenon can be alleviated.

In the liquid crystal display of the present invention, any pixel on the screen can be set in a display state different from its display data. Since the display data conversion circuit can randomly select the pixel that is to be driven in a display state different from its display data, and can change the interval at which the display data conversion is performed, different pixels undergo the display data conversion at different times. As a result, the position of the pixel undergoing the display data conversion changes with time, and the pixel subjected to the display data conversion is not distinctly recognizable with the human eye; this therefore causes little degradation in the display quality. Further, by arbitrarily changing the number of pixels forcibly subjected to the display data change and the interval at which the data change is made, optimization can be made so that no ill effect will be caused to the display quality when, for example, a moving image or a still image is displayed.

Figure 9:
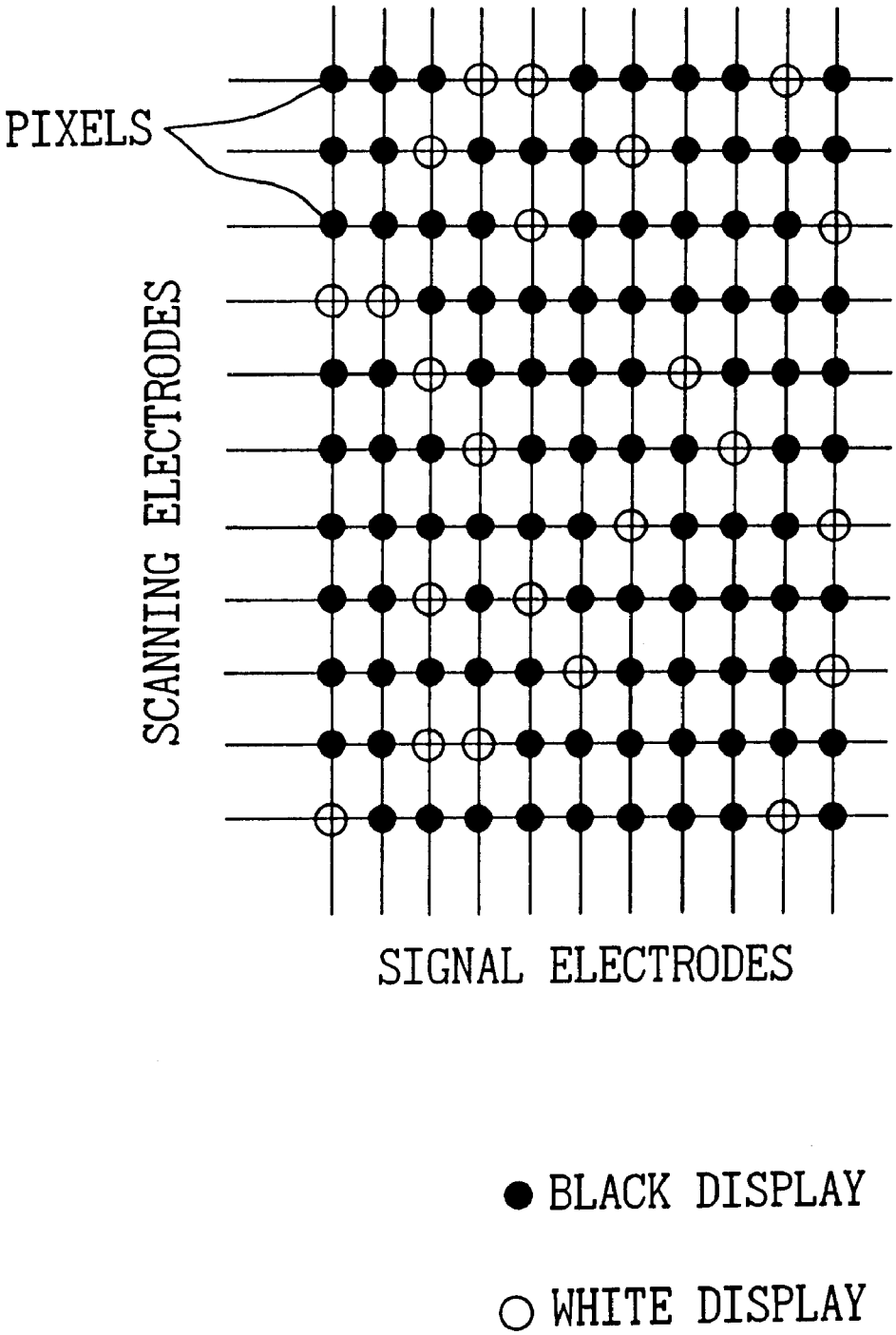
FIG. 9 is a diagram showing an embodiment in which the liquid crystal is driven to produce a black display according to the present invention.

FIG. 9 is a diagram showing a portion of the liquid crystal display screen, illustrating pixel states when all pixels are driven in the black display state. According to the embodiment of the liquid crystal display of the present invention, the display contains a total of about 77,000 pixels, of which 2,400 pixels are subjected to the display data conversion and displayed in the white state different from the actual display data. However, since the pixels forced into the white display state are distributed evenly over the entire screen, no degradation in the display quality is visually observable and burn-in does not occur.

In the case of a screen displaying many still images, better results were obtained by predesignating pixels that were likely to cause intense burn-in, or by arbitrarily changing the interval at which the display data conversion is performed (for example, once for every frame or every three frames) or increasing the number of pixels subjected to forcible conversion per scanning line. On the other hand, in the case of a screen displaying many moving images, better results were obtained by randomly selecting the pixels to be subjected to the display data conversion and automatically changing the conversion interval, or by reducing the number of pixels subjected to forcible conversion per scanning line or automatically changing the number of such pixels.

As for the display state, in the case of the antiferroelectric liquid crystal display of the embodiment of the present invention, setting to the prescribed display state means, for example, producing a white display by causing the layer structure of the liquid crystal to change to the bookshelf structure or a structure close to it. The white display, however, is not always the same; it may be 100% white display state or 80% white display state. That is, the white display includes white display states of different levels. Accordingly, in the present invention, the display data conversion circuit is provided with the function of being able to set the display state to the desired level and to change the level of the display state, in order to alleviate the burn-in phenomenon.

Next, a ferroelectric liquid crystal display was fabricated by filling a ferroelectric liquid crystal into the liquid crystal panel, and was operated for display in the same manner as above. Randomly selected pixels were set in the white display state different from their display data, and every pixel was set in the white display state at least once, regardless of its display data. As a result, in all pixels, the internal electric field due to the spontaneous polarization occurring in the same direction could be prevented from lasting for too long a period and the burn-in phenomenon could be reduced.

Even when active matrix driving capable of directly driving each pixel was employed instead of the time-division driving using the scanning electrodes and signal electrodes, exactly the same effect was obtained.

What is claimed is:

1. A liquid crystal display containing a plurality of pixels arranged in a matrix pattern and having, between a pair of substrates, a liquid crystal exhibiting a smectic phase, comprising:

a circuit for generating display data to write to said pixels;

a circuit for receiving said display data from said display data generating circuit, and for generating a scanning voltage and a signal voltage to be applied to said pixels; and a display data conversion circuit for converting said display data in order to forcibly set random pixels of the plurality of pixels in a prescribed display state for a prescribed period regardless of said display data, the random pixels being distributed throughout the matrix pattern.

2. A liquid crystal display containing a plurality of pixels arranged in a matrix pattern and having, between a pair of substrates, a liquid crystal exhibiting a smectic phase, said substrates having a plurality of scanning electrodes and signal electrodes, respectively, said liquid crystal display comprising:

a display data generating circuit for generating display data to write to said pixels;

a scanning voltage generating circuit for generating, based on said display data from said display data generating circuit, a scanning voltage to be applied to said scanning electrodes;

a signal voltage generating circuit for generating, based on said display data from said display data generating circuit, a signal voltage to be applied to said signal electrodes; and a display data conversion circuit for converting said display data in order to forcibly set random pixels of the plurality of pixels in a prescribed display state for a prescribed period regardless of said display data, the random pixels being distributed throughout the matrix pattern.

3. A liquid crystal display according to claim 1 or 2, wherein said display data conversion circuit is provided between said display data generating circuit and said signal voltage generating circuit.

4. A liquid crystal display according to claim 1 or 2, wherein said display data conversion circuit has a function to designate a pixel whose display data is to be converted.

5. A liquid crystal display according to claim 1 or 2, wherein said display data conversion circuit has a function to randomly select a pixel whose display data is to be converted.

6. A liquid crystal display according to claim 1 or 2, wherein said display data conversion circuit has a function to set the interval at which said display data is converted to an arbitrary value.

7. A liquid crystal display according to claim 1 or 2, wherein said display data conversion circuit has a function to automatically change the interval at which said display data is converted.

8. A liquid crystal display according to claim 1 or 2, wherein said display data conversion circuit has a function to arbitrarily set the number of pixels per scanning line whose display data is to be converted forcefully.

9. A liquid crystal display according to claim 1 or 2, wherein said display data conversion circuit has a function to automatically change the number of pixels per scanning line whose display data is to be converted forcibly.

10. A liquid crystal display according to claim 1 or 2, wherein said display data conversion circuit has a function to set the level of said prescribed display state, to which said conversion is to be made, to an arbitrary level.

11. A liquid crystal display according to claim 1 or 2, wherein said display data conversion circuit has a function to automatically change the level of said prescribed display state to which said conversion is to be made.

12. A liquid crystal display according to claim 1 or 2, wherein said liquid crystal exhibiting a smectic phase is a ferroelectric liquid crystal or an antiferroelectric liquid crystal.